US007392841B2

(12) United States Patent
Murray et al.

(10) Patent No.: US 7,392,841 B2
(45) Date of Patent: Jul. 1, 2008

(54) SELF BOOSTING PACKING ELEMENT

(75) Inventors: Douglas J. Murray, Humble, TX (US); Vel Berzin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 151 days.

(21) Appl. No.: 11/320,112

(22) Filed: Dec. 28, 2005

(65) Prior Publication Data

US 2007/0144733 A1 Jun. 28, 2007

(51) Int. Cl.
*E21B 23/06* (2006.01)

(52) U.S. Cl. ..... 166/137; 166/134; 166/179; 166/387

(58) Field of Classification Search ..... 166/125, 166/137, 182, 195, 134, 179, 387
See application file for complete search history.

(56) References Cited

U.S. PATENT DOCUMENTS

| | | | | |
|---|---|---|---|---|
| 2,207,448 | A * | 7/1940 | Ashbrook | 166/135 |
| 3,918,523 | A | 11/1975 | Stuber | |
| 4,137,970 | A | 2/1979 | Laflin et al. | |
| 4,612,985 | A | 9/1986 | Rubbo et al. | |
| 4,862,967 | A | 9/1989 | Harris | |
| 4,919,989 | A | 4/1990 | Colangelo | |
| 4,936,386 | A | 6/1990 | Colangelo | |
| 5,048,605 | A | 9/1991 | Toon et al. | |
| 5,195,583 | A | 3/1993 | Toon et al. | |
| 5,906,238 | A | 5/1999 | Carmody et al. | |
| 6,073,692 | A | 6/2000 | Wood et al. | |
| 6,834,725 | B2 | 12/2004 | Whanger et al. | |
| 6,848,505 | B2 | 2/2005 | Richard et al. | |
| 6,854,522 | B2 | 2/2005 | Brezinski et al. | |
| 2004/0020662 | A1 | 2/2004 | Freyer | |
| 2004/0055760 | A1 | 3/2004 | Nguyen | |
| 2004/0118572 | A1 | 6/2004 | Whanger et al. | |
| 2004/0194971 | A1 * | 10/2004 | Thomson | 166/387 |
| 2004/0261990 | A1 | 12/2004 | Bosma et al. | |
| 2005/0067170 | A1 | 3/2005 | Richard | |
| 2005/0092363 | A1 | 5/2005 | Richard et al. | |
| 2005/0110217 | A1 | 5/2005 | Wood et al. | |
| 2005/0171248 | A1 | 8/2005 | Li et al. | |

FOREIGN PATENT DOCUMENTS

| | | |
|---|---|---|
| JP | 04-363499 | 12/1992 |
| JP | 09-151686 | 6/1997 |
| JP | 2000-064764 | 2/2000 |
| WO | WO 2004/018836 A1 | 3/2004 |

* cited by examiner

*Primary Examiner*—Jennifer H Gay
*Assistant Examiner*—Brad Harcourt
(74) *Attorney, Agent, or Firm*—Steve Rosenblatt

(57) ABSTRACT

A packer assembly features one or more elements that preferably swell when in contact with well fluids and have a feature in them that responds to an applied load in a given direction by retaining such a boost force with a locking mechanism. A single element can have two such mechanisms that respond to applied forces from opposed directions. Friction force for adhering the element to the mandrel is enhanced with surface treatments between them that still allow the locking mechanisms to operate.

9 Claims, 1 Drawing Sheet

SELF BOOSTING PACKING ELEMENT

FIELD OF THE INVENTION

The field of this invention is generally plugs and packers for downhole use and more particularly packers that have a sealing element that swells and retains boost forces when subjected to pressure differentials.

BACKGROUND OF THE INVENTION

Packers and plugs are used downhole to isolate zones and to seal off part of or entire wells. There are many styles of packers on the market. Some are inflatable and others are mechanically set with a setting tool that creates relative movement to compress a sealing element into contact with a surrounding tubular. Generally, the length of such elements is reduced as the diameter is increased. Pressure is continued from the setting tool so as to build in a pressure into the sealing element when it is in contact with the surrounding tubular.

More recently, packers have been used that employ elements that respond to the surrounding well fluids and swell to form a seal. Many different materials have been disclosed as capable of having this feature and some designs have gone further to prevent swelling until the packer is close to the position where it will be set. These designs were still limited to the amount of swelling from the sealing element as far as the developed contact pressure against the surrounding tubular or wellbore. The amount of contact pressure is a factor in the ability to control the level of differential pressure. In some designs there were also issues of extrusion of the sealing element in a longitudinal direction as it swelled radially but no solutions were offered. A fairly comprehensive summation of the swelling packer art appears below:

I. References Showing a Removable Cover Over a Swelling Sleeve

1) Application US 2004/0055760 A1

FIG. 2*a* shows a wrapping 110 over a swelling material 102. Paragraph 20 reveals the material 110 can be removed mechanically by cutting or chemically by dissolving or by using heat, time or stress or other ways known in the art. Barrier 110 is described in paragraph 21 as an isolation material until activation of the underlying material is desired. Mechanical expansion of the underlying pipe is also contemplated in a variety of techniques described in paragraph 24.

2) Application US 2004/0194971 A1

This reference discusses in paragraph 49 the use of water or alkali soluble polymeric covering so that the actuating agent can contact the elastomeric material lying below for the purpose of delaying swelling. One way to accomplish the delay is to require injection into the well of the material that will remove the covering. The delay in swelling gives time to position the tubular where needed before it is expanded. Multiple bands of swelling material are illustrated with the uppermost and lowermost acting as extrusion barriers.

3) Application US 2004/0118572 A1

In paragraph 37 of this reference it states that the protective layer 145 avoids premature swelling before the downhole destination is reached. The cover does not swell substantially when contacted by the activating agent but it is strong enough to resist tears or damage on delivery to the downhole location. When the downhole location is reached, pipe expansion breaks the covering 145 to expose swelling elastomers 140 to the activating agent. The protective layer can be Mylar or plastic.

4) U.S. Pat. No. 4,862,967

Here the packing element is an elastomer that is wrapped with an imperforate cover. The coating retards swelling until the packing element is actuated at which point the cover is "disrupted" and swelling of the underlying seal can begin in earnest, as reported in Column 7.

5) U.S. Pat. No. 6,845,322

This patent has many embodiments. The one in FIG. 26 is foam that is retained for run in and when the proper depth is reached expansion of the tubular breaks the retainer 272 to allow the foam to swell to its original dimension.

6) Application US 2004/0020662 A1

A permeable outer layer 10 covers the swelling layer 12 and has a higher resistance to swelling than the core swelling layer 12. Specific material choices are given in paragraphs 17 and 19. What happens to the cover 10 during swelling is not made clear but it presumably tears and fragments of it remain in the vicinity of the swelling seal.

7) U.S. Pat. No. 3,918,523

The swelling element is covered in treated burlap to delay swelling until the desired wellbore location is reached. The coating then dissolves of the burlap allowing fluid to go through the burlap to get to the swelling element 24 which expands and bursts the cover 20, as reported in the top of Column 8.

8) U.S. Pat. No. 4,612,985

A seal stack to be inserted in a seal bore of a downhole tool is covered by a sleeve shearably mounted to a mandrel. The sleeve is stopped ahead of the seal bore as the seal first become unconstrained just as they are advanced into the seal bore.

II. References Showing a Swelling Material under an Impervious Sleeve

1) Application US 2005/0110217

An inflatable packer is filled with material that swells when a swelling agent is introduced to it.

2) U.S. Pat. No. 6,073,692

A packer has a fluted mandrel and is covered by a sealing element. Hardening ingredients are kept apart from each other for run in. Thereafter, the mandrel is expanded to a circular cross section and the ingredients below the outer sleeve mix and harden. Swelling does not necessarily result.

3) U.S. Pat. No. 6,834,725

FIG. 3*b* shows a swelling component 230 under a sealing element 220 so that upon tubular expansion with swage 175 the plugs 210 are knocked off allowing activating fluid to reach the swelling material 230 under the cover of the sealing material 220.

4) U.S. Pat. No. 5,048,605

A water expandable material is wrapped in overlapping Kevlar sheets. Expansion from below partially unravels the Kevlar until it contacts the borehole wall.

5) U.S. Pat. No. 5,195,583

Clay is covered in rubber and a passage leading from the annular space allows well fluid behind the rubber to let the clay swell under the rubber.

6) Japan Application 07-334115

Water is stored adjacent a swelling material and is allowed to intermingle with the swelling material under a sheath 16.

III. References Which Show an Exposed Sealing Element that Swells on Insertion

1) U.S. Pat. No. 6,848,505

An exposed rubber sleeve swells when introduced downhole. The tubing or casing can also be expanded with a swage.

2) PCT Application WO 2004/018836 A1

A porous sleeve over a perforated pipe swells when introduced to well fluids. The base pipe is expanded downhole.

3) U.S. Pat. No. 4,137,970

A swelling material 16 around a pipe is introduced into the wellbore and swells to seal the wellbore.

4) US Application US 2004/0261990

Alternating exposed rings that respond to water or well fluids are provided for zone isolation regardless of whether the well is on production or is producing water.

5) Japan Application 03-166,459

A sandwich of slower swelling rings surrounds a faster swelling ring. The slower swelling ring swells in hours while the surrounding faster swelling rings do so in minutes.

6) Japan Application 10-235,996

Sequential swelling from rings below to rings above trapping water in between appears to be what happens from a hard to read literal English translation from Japanese.

7) U.S. Pat. No. 4,919,989 and 4,936,386

Bentonite clay rings are dropped downhole and swell to seal the annular space, in these two related patents.

8) US Application US 2005/009363 A1

Base pipe openings are plugged with a material that disintegrates under exposure to well fluids and temperatures and produces a product that removes filter cake from the screen.

9) U.S. Pat. No. 6,854,522

FIG. 10 of this patent has two materials that are allowed to mix because of tubular expansion between sealing elements that contain the combined chemicals until they set up.

10) US Application US 2005/0067170 A1

Shape memory foam is configured small for a run in dimension and then run in and allowed to assume its former shape using a temperature stimulus.

IV. Reference that Shows Power Assist Actuated Downhole to Set a Seal

1) U.S. Pat. No. 6,854,522

This patent employs downhole tubular expansion to release potential energy that sets a sleeve or inflates a bladder. It also combines setting a seal in part with tubular expansion and in part by rotation or by bringing slidably mounted elements toward each other. FIGS. 3, 4, 17-19, 21-25, 27 and 36-37 are illustrative of these general concepts.

The various concepts in U.S. Pat. No. 6,854,522 depend on tubular expansion to release a stored force which then sets a material to swelling. As noted in the FIG. 10 embodiment there are end seals that are driven into sealing mode by tubular expansion and keep the swelling material between them as a seal is formed triggered by the initial expansion of the tubular.

What has been lacking is a technique for automatically capturing applied differential pressures to a set element, particularly when set by swelling in reaction to exposure to well fluids, and retaining that force in the element to retain or/and boost its sealing capabilities downhole. The present invention offers various embodiments that capture boost forces from differential loading in the uphole or downhole directions and various embodiments to accomplish such capture in a single element or multiple elements on a single or multiple mandrels. Those skilled in the art will more readily appreciate the scope of the invention from a review of the description of the preferred and alternative embodiments, the drawing and the claims that appear below and define the full scope of the invention.

SUMMARY OF THE INVENTION

A packer assembly features one or more elements that preferably swell when in contact with well fluids and have a feature in them that responds to an applied load in a given direction by retaining such a boost force with a locking mechanism. A single element can have two such mechanisms that respond to applied forces from opposed directions. Friction force for adhering the element to the mandrel is enhanced with surface treatments between them that still allow the locking mechanisms to operate.

DETAILED DESCRIPTION OF THE PREFERRED EMBODIMENT

Figure 1:
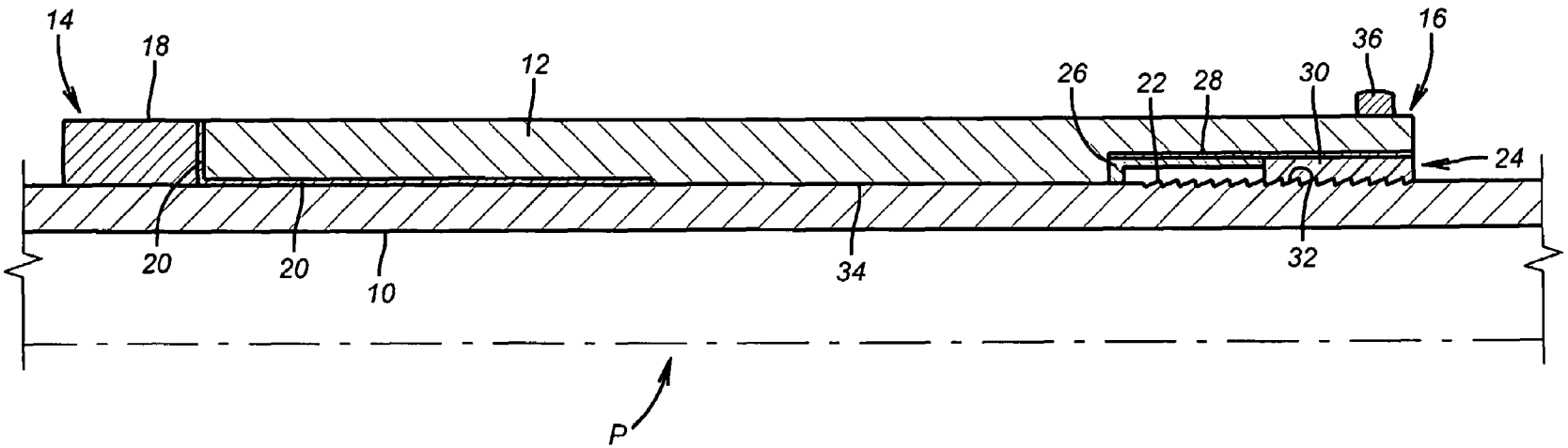
FIG. 1 is a section view showing a sealing element that is fixed on one end and has the locking feature for capturing a boost force in one direction at the opposite end and shown in the run in position.

FIG. 1 will be used to illustrate a variety of variations of the present invention. What is illustrated in the Figure is a mandrel 10 for a packer P. Mounted to the mandrel 10 is an element 12 that preferably is of the type that swells in contact with well fluids using materials described in the patents and applications discussed above. A covering (not shown) can also be applied to the element 12 to provide a time delay to allow the packer P to be positioned close to where it needs to be set. The materials that accomplish this delay using a cover that goes away after a time exposure to well fluids and predetermined temperatures are also discussed in the patents and applications above.

In the Figure, the element assembly 12 has an uphole end 14 and a downhole end 16. In one variation that is shown, the uphole end 14 is abutting a block 18 and is further secured to it and between itself and mandrel 10 with an adhesive or some type of bonding material 20 compatible with well materials and temperatures. Block 18 can be a ring welded to the mandrel 10 or can be attached with adhesive or threads or can be integral to the mandrel. While the element 12 can swell radially along its length, differential loading from the uphole end 14 toward the downhole end 16 will not budge the element away from block 18 due to the presence of bonding material 20. In the embodiment of the Figure, any net downhole force from such loading will not add an additional sealing force into the element 12 because the upper end of the embodiment in the Figure is bonded and stationary, unlike the opposite end that has a ratchet feature, as will be described below. However, if there is differential loading after the element 12 swells to a sealing position the result will be that pressure applied in that direction will cause the downhole end 16 to ride toward uphole end 14 thus shortening the length of the element 12 while increasing its internal pressure. This increase in internal pressure will enhance the sealing force of the element to allow it to withstand even greater differentials going from the downhole end 16 to the uphole end 14. To lock in that boost force that comes from loading due to increasing pressure conditions near the downhole end 16, it is desirable to lock in such boost forces when they occur. To accomplish this, the mandrel 10 has a series of serrations or other rough surface treatment 22 adjacent downhole end 16. The element 12 has an undercut 24 where ring 26 is secured with an adhesive or other bonding material 28 adjacent a ring 30 with an interior serrated surface 32. Surfaces 22 and 32 ride over each other in one direction like a ratchet but lock upon relative movement in an opposed direction. Ring 30 is also bonded to element 12 with adhesive such as 28. Rings 26 and 30 can be separate or unitary. In this version, the central section 34 is not bonded to mandrel 10. This allows the length of the element 12 to decrease in response to a net force when the element 12 is set and compressed from an uphole directed force. Such a force results in ratcheting between surfaces 22 and 32 to lock in a greater force into the swelled element 12 against a surrounding tubular or an open hole (neither of which are shown).

Those skilled in the art will appreciate that the design shown in FIG. 1 can be inverted so that net forces in the downhole direction or toward the right in FIG. 1 will result in locking in a greater sealing force in the element 12.

Another variation is to use two packers P mounted adjacent each other with opposed orientations for the locking device so that net forces in an uphole or downhole direction will each result in capturing a greater sealing force in the element 12. Alternatively, a single mandrel 10 can house two elements of the type shown in FIG. 1 except that they are in mirror image orientation to allow capturing additional sealing force in the element 12 regardless of the direction of the net applied force. In yet another alternative, the assembly shown in undercut 24 can be disposed on opposed ends of the same element with a binder such as 20 being disposed only in the middle portion 34. In that manner, a net force in either direction will cause a ratcheting action that retains a greater sealing force in the element 12.

While a ratchet based system for locking in additional sealing force has been illustrated other mechanisms that permit unidirectional compression of the element from applied differential pressure loads on a set element 12 downhole are well within the scope of the invention.

Referring again to FIG. 1 an additional feature can be added to deal with the issue of relative movement during delivery to the packer P to the desired location for setting. Portions of the mandrel 10 can receive a roughening surface treatment in the form of grooves or adhered particles that will enhance the grip on element 12. Of course, the location of such treatment of the mandrel 10 need to be placed in locations where longitudinal compression of the element 12 from pressure loading will not be impaired. For example, in the embodiment literally shown in FIG. 1 the block 18 will adequately resist shifting of the element 12 during run in. The middle section 34 will need to permit sliding to allow the ratcheting movement between teeth 22 and 32. To prevent premature ratcheting during run in, a ring 36 can retain end 16 during run in and can be made of a material that dissolves or goes away over time to let the ratcheting or other pressure enhancing device hold in the greater sealing force from pressure loading on the set element 12. This can be in the form of a coated threaded ring where the coating only dissolves after a time exposure at a given temperature. After that the well fluids attack the ring to the point of failure and the swelling of the element 12 can begin to set the packer P. Alternatively, the swelling of the element 12 can defeat the retainer 36 as could simply swaging the mandrel 10.

However, if the version shown in FIG. 1 is revised so what is depicted at end 16 is also at end 14 in a mirror image, then it would make sense to surface treat the mandrel 10 in the middle section 34 as that section would not be moving during normal operation of the packer P. The surface treatment on the mandrel 10 can also act to hold the boost force from pressure loading that is anticipated once the packer P goes in service. Alternatively the element 12 itself can have a surface treatment where it contacts the mandrel 10 or both can be treated in the area of contact. Surface treatment on the mandrel can be multiple grooves, for example.

The above description is illustrative of the preferred embodiment and many modifications may be made by those skilled in the art without departing from the invention whose scope is to be determined from the literal and equivalent scope of the claims below:

We claim:

1. A packer for sealing a borehole, comprising:
a mandrel;
an element on said mandrel that swells from exposure to well fluids; and
a locking device to retain applied force placed on the element when engaged to the borehole;
said locking device is prevented from operating during run in;
said locking device is retained by a retainer during run in and said retainer fails near the intended location for the packer in the borehole;
said retainer fails by expansion of said mandrel.

2. A packer for sealing a borehole, comprising:
a mandrel;
an element on said mandrel that swells from exposure to well fluids; and
a locking device to retain applied force placed on the element when engaged to the borehole;
at least one of said mandrel and said element comprise a surface treatment in contact during run in to assist in retaining their relative positions.

3. The packer of claim 2, wherein:
said surface treatment retains said element to said mandrel in response to applied pressure that is locked in by said locking device.

4. A packer for sealing a borehole, comprising:
a mandrel;
an element on said mandrel that swells from exposure to well fluids; and
a locking device to retain applied force placed on the element when engaged to the borehole;
said element is bonded to said mandrel at least in part.

5. The packer of claim 4, wherein:
said bonding is located at an end opposite from the location of said locking device.

6. The packer of claim 4, wherein:
said locking device is located at opposed ends of said element in mirror image orientations and said bonding is disposed in between said ends.

7. A packer for sealing a borehole, comprising:
a mandrel;
an element on said mandrel that swells from exposure to well fluids; and
a locking device to retain applied force placed on the element when engaged to the borehole;
said locking device is located in an undercut area on said element that faces said mandrel.

8. The packer of claim 7, wherein:
said locking device is bonded to said undercut.

9. A packer for sealing a borehole, comprising:
a mandrel;
an element on said mandrel that swells from exposure to well fluids; and
a locking device to retain applied force placed on the element when engaged to the borehole;
said locking device comprises a ratcheting ring mounted to said element and unidirectionally movable on teeth on said mandrel.

* * * * *